US009803404B2

(12) United States Patent
Cobb et al.

(10) Patent No.: US 9,803,404 B2
(45) Date of Patent: Oct. 31, 2017

(54) ADJUSTABLE DOOR ASSEMBLY FOR A SHOWER ENCLOSURE AREA

(71) Applicant: Coastal Industries, Inc., Jacksonville, FL (US)

(72) Inventors: Patrick Cobb, Jacksonville, FL (US); William M. Cobb, Jr., Jacksonville, FL (US); Florin Poenariu, Jacksonville, FL (US)

(73) Assignee: Coastal Industries, Inc., Jacksonville, FL (US)

( * ) Notice: Subject to any disclaimer, the term of this patent is extended or adjusted under 35 U.S.C. 154(b) by 0 days.

(21) Appl. No.: 15/044,870

(22) Filed: Feb. 16, 2016

(65) Prior Publication Data

US 2016/0237728 A1 Aug. 18, 2016

Related U.S. Application Data

(60) Provisional application No. 62/116,767, filed on Feb. 16, 2015.

(51) Int. Cl.

| | |
|---|---|
| ***A47K 3/00*** | (2006.01) |
| ***E05D 7/04*** | (2006.01) |
| ***A47K 3/36*** | (2006.01) |
| ***E05D 7/081*** | (2006.01) |
| *E05D 1/04* | (2006.01) |

(52) U.S. Cl.

CPC ..... *E05D 7/04* (2013.01); *A47K 3/36* (2013.01); *E05D 7/081* (2013.01); *E05D 1/04* (2013.01); *E05Y 2600/628* (2013.01); *E05Y 2900/114* (2013.01)

(58) Field of Classification Search

CPC .. E05D 7/04; E05D 7/081; E05D 1/04; A47K 3/36; E05Y 2900/114; E05Y 2600/628

USPC ..... 4/612, 614

See application file for complete search history.

(56) References Cited

U.S. PATENT DOCUMENTS

| | | | | | |
|---|---|---|---|---|---|
| 2,739,674 | A * | 3/1956 | Casebolt | E06B 1/18 | 49/505 |
| 3,359,594 | A * | 12/1967 | Pastoor | E06B 3/481 | 16/356 |
| 3,553,891 | A * | 1/1971 | Pastoor | A47K 3/36 | 49/505 |
| 4,968,171 | A * | 11/1990 | Shell | E04B 2/7427 | 16/224 |
| 5,363,616 | A * | 11/1994 | Hernandez | A47K 3/36 | 16/355 |
| 5,448,799 | A * | 9/1995 | Stein, Jr. | E05D 5/10 | 16/225 |

(Continued)

FOREIGN PATENT DOCUMENTS

| | | | | |
|---|---|---|---|---|
| DE | 3844486 A1 * | 7/1990 | A47K 3/36 | |
| DE | 4428740 A1 * | 2/1996 | A47K 3/30 | |

(Continued)

*Primary Examiner* — Jerry Redman

(74) *Attorney, Agent, or Firm* — Rogers Towers PA; Joseph Kincart; Andres Arrubla

(57) ABSTRACT

A door assembly comprising a hinge post and a hinge stile, the hinge post and hinge stile configured for a first mating configuration and a second mating configuration. The first and second mating configurations enable adjustable placement of a shower door with the hinge post forming an extension below the bottom of the hinge stile in both configurations.

16 Claims, 10 Drawing Sheets

(56) References Cited

U.S. PATENT DOCUMENTS

| | | | | | |
|---|---|---|---|---|---|
| 5,564,806 | A * | 10/1996 | Keisling | A47B 47/0033 312/107 |
| 5,809,617 | A * | 9/1998 | Harris | E05D 1/04 16/267 |
| 5,867,871 | A * | 2/1999 | Tasman | E05D 11/1014 16/335 |
| 6,035,460 | A * | 3/2000 | Borter | A47K 3/36 4/605 |
| 8,627,610 | B1 * | 1/2014 | Crowther | E04H 1/1266 16/250 |
| 8,869,459 | B2 * | 10/2014 | Wei | A47K 3/30 4/612 |
| 2007/0151164 | A1 * | 7/2007 | Marshall | A47K 3/36 49/397 |
| 2016/0208531 | A1 * | 7/2016 | Corpuz, Jr. | E05D 5/0246 |

FOREIGN PATENT DOCUMENTS

| | | | | | |
|---|---|---|---|---|---|
| EP | 0290304 | A2 * | 11/1988 | A47K 3/34 |
| EP | 0541877 | A1 * | 5/1993 | A47K 3/36 |
| FR | 2617034 | A2 * | 12/1988 | A47K 3/36 |
| WO | WO 2006054942 | A1 * | 5/2006 | A47K 3/36 |

* cited by examiner

ADJUSTABLE DOOR ASSEMBLY FOR A SHOWER ENCLOSURE AREA

CROSS-REFERENCE TO RELATED APPLICATION

Pursuant to 35 U.S.C. §119(e), this application claims the benefit of United States Provisional Patent Application Ser. No. 62/116,767, filed on Feb. 16, 2015, the entire contents of which are incorporated herein by this reference.

BACKGROUND

1. Field of Invention

The present invention generally relates to indoor glass enclosures, and more specifically to adjustable enclosures for indoor shower areas.

2. Description of Related Art

Indoor shower facilities typically include a shower with a door assembly, at least partially enclosing the shower to reduce verspray from the shower. Typical shower enclosure areas may include corner units installed in a corner of a bathroom, walk-in shower enclosures, partitions attached to the wall of bathtubs, or other similar structural arrangements. These different shower enclosure door assemblies have one or more panels attached in a hinging manner to the frame of the enclosure. In many circumstances, the door frame of the shower area is customized, misaligned, or fabricated in some other non-standard manner. As a result, a standard door assembly or closure device will not fit correctly or may be difficult to operate due to the misalignment, unless time consuming and costly alterations are made to the standard components of the door assembly.

Prior shower closure systems incorporate a hinge post rotatably connected to a hinge stile. In many systems, it is desirable for the bottom of the hinge stile to be raised with respect to the hinge post to allow for clearance for base members, dams, or other members or frames. An extension at the bottom of the hinge post serves this purpose. In some closure systems, the door is to swing in a certain direction, for example away from the shower closure area. In some applications, the outward swinging door is to be mounted on the left side of the closure area, and in other applications the outward swinging door is to be mounted on the right side of the closure area. To maintain this outward-swinging orientation of the door, the hinge post and hinge stile must be inverted, or placed upside down, to move these members from being mounted on one side of the shower closure doorway to mounting on the other side.

In these systems, in order to provide for a hinge post extension at the bottom of the hinge post, the hinge post must be manufactured to an excess length that provides for both a top extension above the top of the hinge stile, and a bottom extension below the bottom of the hinge stile. At the job site, once the proper orientation of the hinge post is determined, the top extension is cut away so that the respective tops of the hinge post and hinge stile are flush, while the bottom hinge post extension remains.

It is an object of the present door assembly to enable interchangeable right or left placement of standard hinge post and hinge stile members without the need for cutting or customizing at the job site.

SUMMARY OF THE PREFERRED EMBODIMENTS

The door assembly disclosed herein generally comprises a door connected to door wall jamb by a door hinge assembly, a sill assembly, and a panel connected to panel wall jamb and supported by a setting assembly. The shower area opening is enclosed by placing the door beside the panel and connecting the respective panels to the respective wall jambs. The door wall jamb and the panel wall jamb comprise legs that mate with the adjacent member. For example, the legs of the door wall jamb mate with corresponding extensions on the hinge post in an overlapping manner. Likewise, the legs of the panel wall jamb mate with the panel by receiving the panel slidably positioned between the legs. Thus, the length of the legs allows the respective jambs to accommodate misaligned or nonstandard door frames, providing greater adjustability to the standard panels to accommodate these door frame fabrication errors.

For example, where a frame is fabricated too wide, the standard panel sizes of the door and panel are not enough to span the irregular width of the opening, which could leave unsightly gaps in the door assembly. Extended legs can be used on the panel wall jamb to cover these unwanted gaps, so that custom fabrication of the door and panel members is not needed. In the same manner, when the frame is out of plumb or misaligned, the jambs can be placed in a non-parallel orientation with respect to their adjoining members. This enables installation of the square door assembly to misaligned frames without the need for customization to the other components of the door assembly.

The hinge stile comprises four fastener holes to enable interchangeable placement of the hinge post from the left side to the right side of the shower closure area. The fastener holes enable interchangeable placement of standard hinge posts and hinge stiles without the need to further customize these members during installation.

DETAILED DESCRIPTION OF THE PREFERRED EMBODIMENTS

With reference to the drawings, the door assembly will now be described with regard to the best mode and the preferred embodiments. In general, the device is an improved adjustable door assembly for a shower enclosure. The embodiments disclosed herein are meant for illustration and not limitation of the invention. An ordinary practitioner will appreciate that it is possible to create many variations of the following embodiments without undue experimentation.

Figure 1:
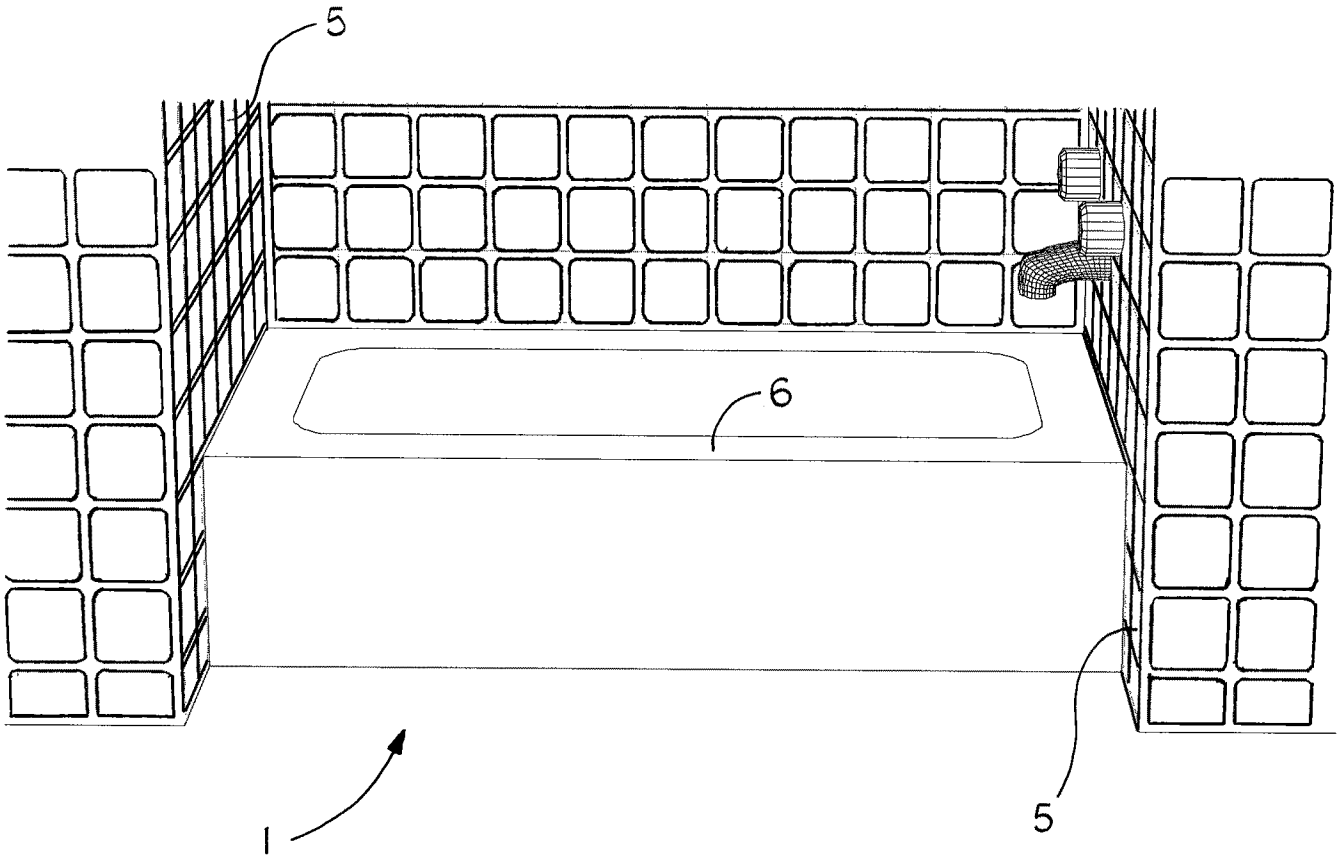
FIG. 1 shows the bottom portion of the opening of a typical indoor shower closure area.
Figure 2:
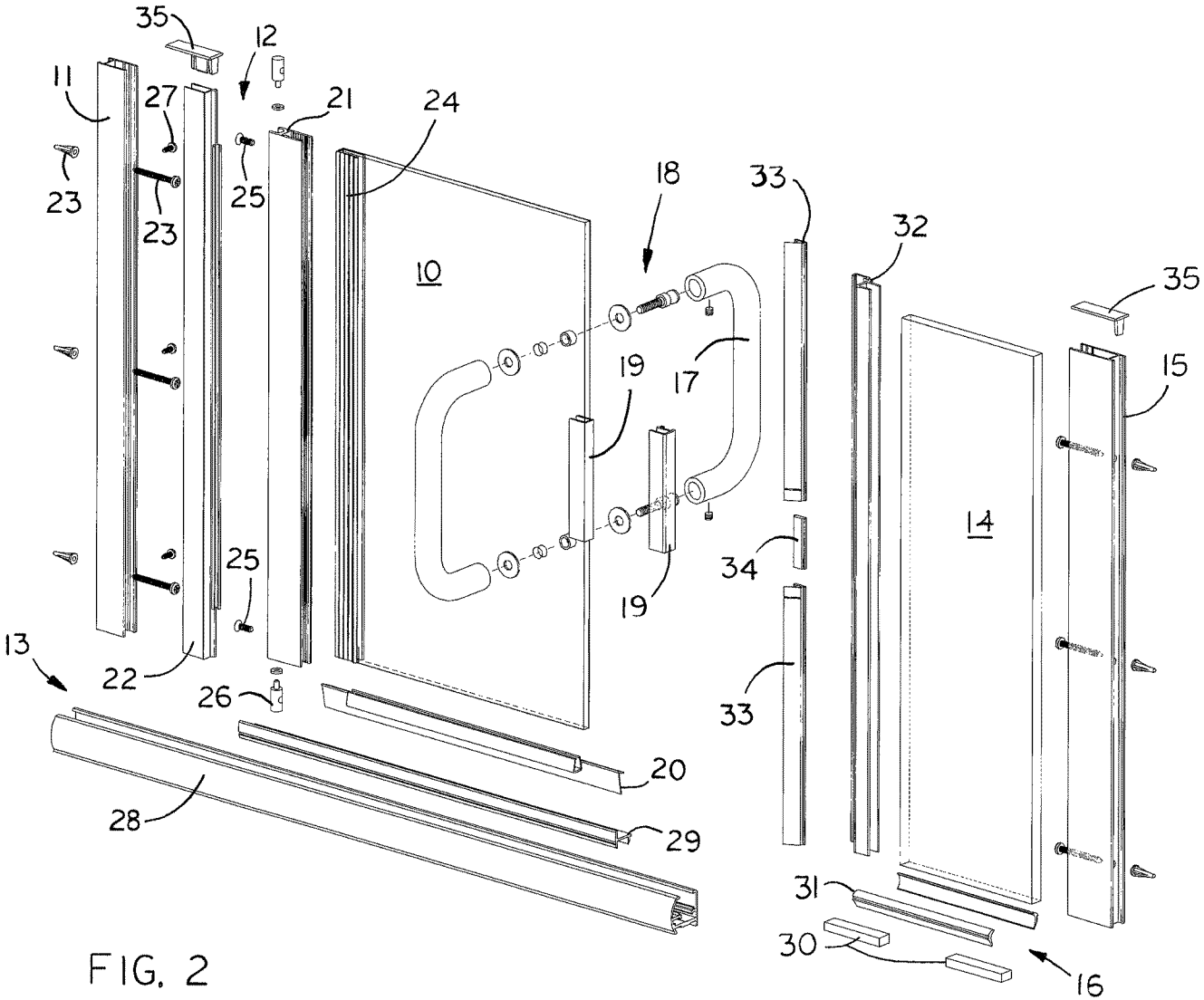
FIG. 2 is an exploded view of the shower enclosure device and door assembly.

Referring to FIG. 1, many shower areas 1 have walls on three sides, with a fourth side being wholly or partially open. These open sides have a frame 5 and a shower curb 6 that define the shower opening. Referring to FIG. 2, a typical door assembly generally comprises a door 10 connected to door wall jamb 11 by a door hinge assembly 12, a sill assembly 13, and a panel 14 connected to panel wall jamb 15 and supported by a setting assembly 16. The shower area opening is enclosed by placing the door 10 beside the panel 14 within the opening. Various embodiments of the door 10 comprise one or more handle members 17 attached to the door by mechanical handle connectors 18. Other features of the door 10 include strike plates 19 as needed, or a drip rail member 20 connected to the bottom of the door 10 and fitting above the sill assembly 13 when the door 10 is in the closed position.

The door hinge assembly 12 comprises hinge members permitting the door to swing in relation to the door wall jamb 11. For example, in one embodiment the door hinge assembly 12 comprises a hinge stile 21 joined to the door 10 and a hinge post 22 joined to the door wall jamb 11, which is joined to the frame 5 by mechanical anchor members 23. The hinge stile 21 and hinge post 22 are connected in a rotatable manner, such as by a hinged connection, thereby permitting the door 10 to swing in relation to the door wall jamb 11. The hinge stile 21 is secured to the hinge post 22 by one or more hinge pins 26. One embodiment of the hinge members further comprises glazing vinyl 24 that fits to the hinge stile 21, which is secured to the door 10 by one or more assembly fasteners 25.

The sill assembly 13 comprises a base member 28 supporting a dam sill 29, and the sill assembly 13 is joined to the shower curb 6. The panel 14 is seated on the sill assembly 13 and placed in communication with the panel wall jamb 15, which is joined to the frame 5 by mechanical anchor members 23. The panel 14 is further supported by the setting assembly 16, which comprises setting blocks 30 and seals 31. The panel 14 is seated on the setting blocks 30, and the seals 31 are placed along the interface of the panel 14 and setting blocks 30 in a manner that stabilizes the panel 14 against lateral movement and prevents water leakage along this interface. The panel 14 is further fitted with a strike post 32 having a strike seal 33 that enables a substantially water-tight closure when the door 10 closes and contacts the strike seal 33. In one embodiment, the strike post 32 and the door 10 are fitted with a magnet closure member 34 that provides a magnetic closure force to hold the door 10 shut when in contact with the strike seal 33. After assembly, the hinge post 22 and the panel wall jamb 15 are fitted with a jamb cap 35 to seal these respective members against intrusion of debris or water.

Figure 3:
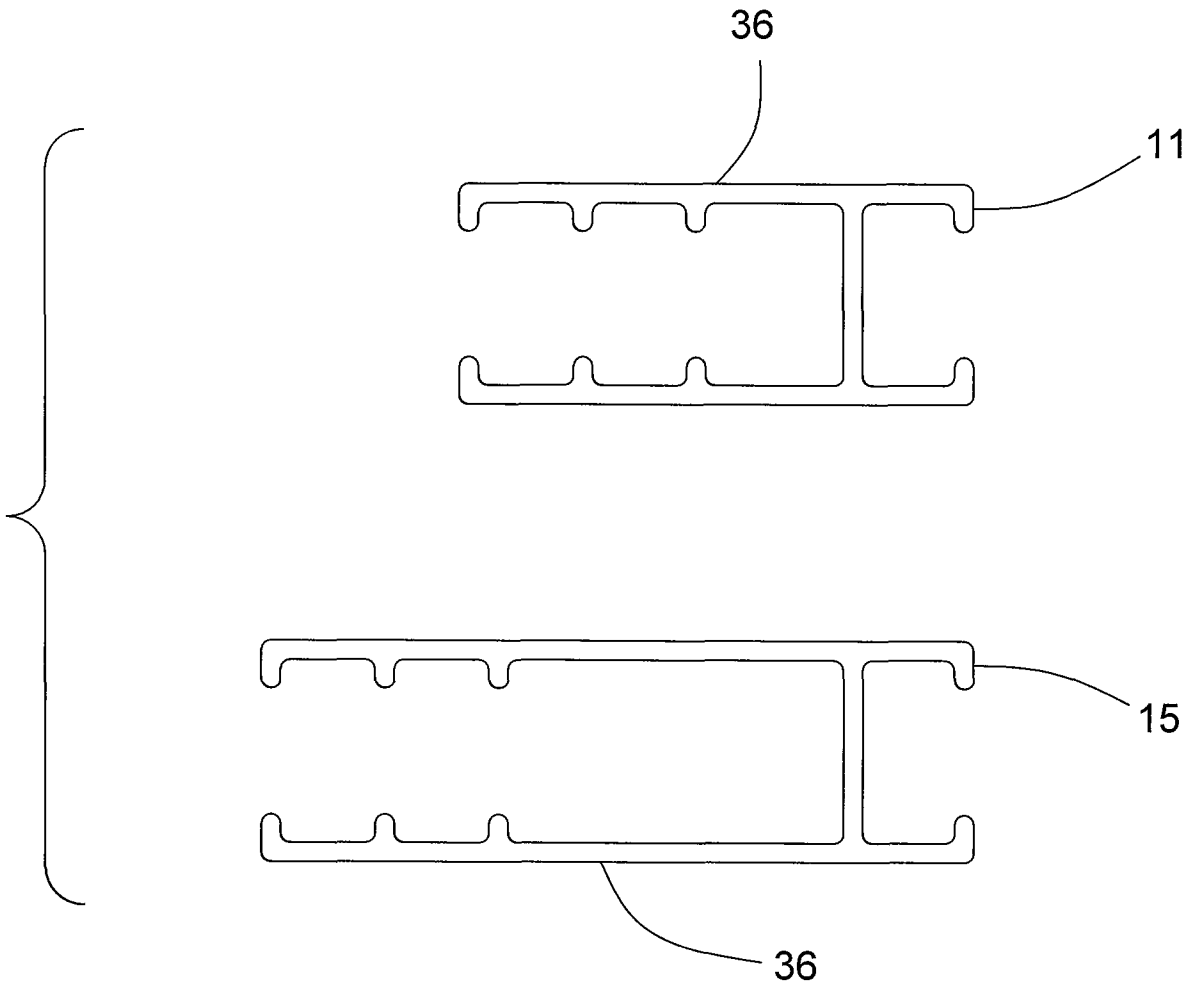
FIG. 3 shows the cross sectional details of alternate sizes of a typical panel wall jamb.

Referring to FIG. 3, the door wall jamb 11 and the panel wall jamb 15 comprise legs 36 that mate with the adjacent member. For example, the legs 36 of the door wall jamb 11 mate with corresponding extensions on the hinge post 22 in an overlapping manner. Likewise, the legs 36 of the panel wall jamb 15 mate with the panel 14 by receiving the panel 14 slidably positioned between the legs 36. Thus, the length of the legs 36 allows the respective jambs 11, 15 to accommodate mis-sized, misaligned, or out of plumb door frames, providing greater adjustability to the standard panels to accommodate these door frame fabrication errors. This increased adjustability enables a large time savings in installing the shower door enclosures.

For example, where a frame 5 is fabricated too wide, the standard panel sizes of the door 10 and panel 14 are not enough to span the irregular width of the opening, which could leave unsightly gaps in the door assembly. Extended legs 36 are used on the panel wall jamb 15 to cover these unwanted gaps so that custom fabrication of the door 10 and panel 14 members is not needed. In the same manner, when the frame 5 is out of plumb or misaligned, the jambs 11, 15 can be placed in a non-parallel orientation with respect to their adjoining members. This enables installation of the square door assembly to misaligned frames 5 without the need for customization to the other components of the door assembly.

Figure 4:
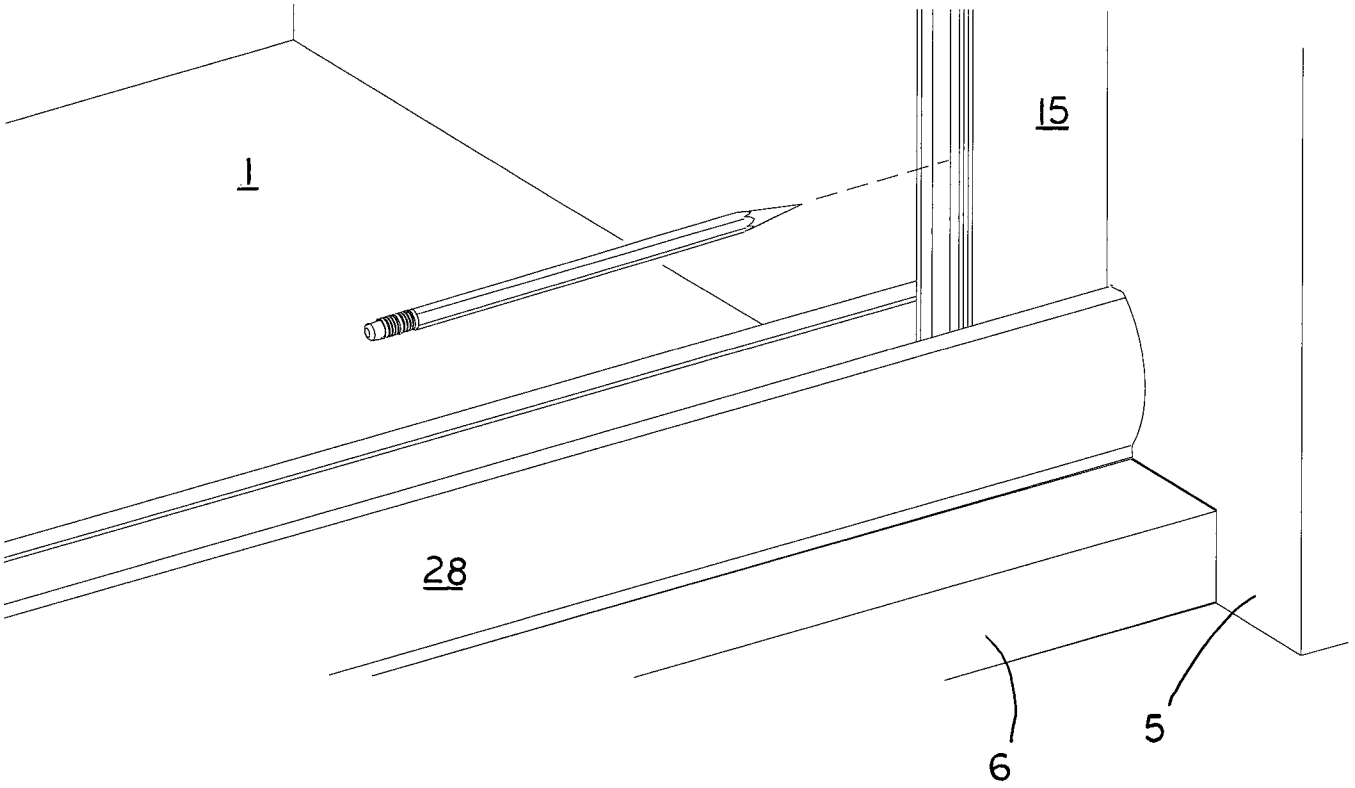
FIG. 4 shows the shower curb and base member with a wall jamb placed against the doorframe during assembly.

Referring to FIG. 4, in one embodiment of a method for installing the shower closure system, the width of the frame 5 is measured along the center of the shower curb 6, and the sill assembly 13 base member 28 is trimmed to slightly smaller than the measurement obtained. The base member 28 is then positioned at the center of shower curb 6 and temporarily taped in place to prevent movement. The door wall jamb 11 and the panel wall jamb 15 are then placed on the ends of the base member 28 and against the shower walls. The jambs 11, 15 are then plumbed, and the installation hole locations on the shower walls are pencil marked. The jambs 11, 15 are removed, installation holes are drilled in the frame 5 for receiving the anchor members 23 (shown in FIG. 2), and female anchor members 23 are inserted into the holes. The jambs 11, 15 are then repositioned as before and secured to the frame 5 by inserting male anchor members 23 through the jambs 11, 15 and into the corresponding female anchor members 23.

Figure 5:
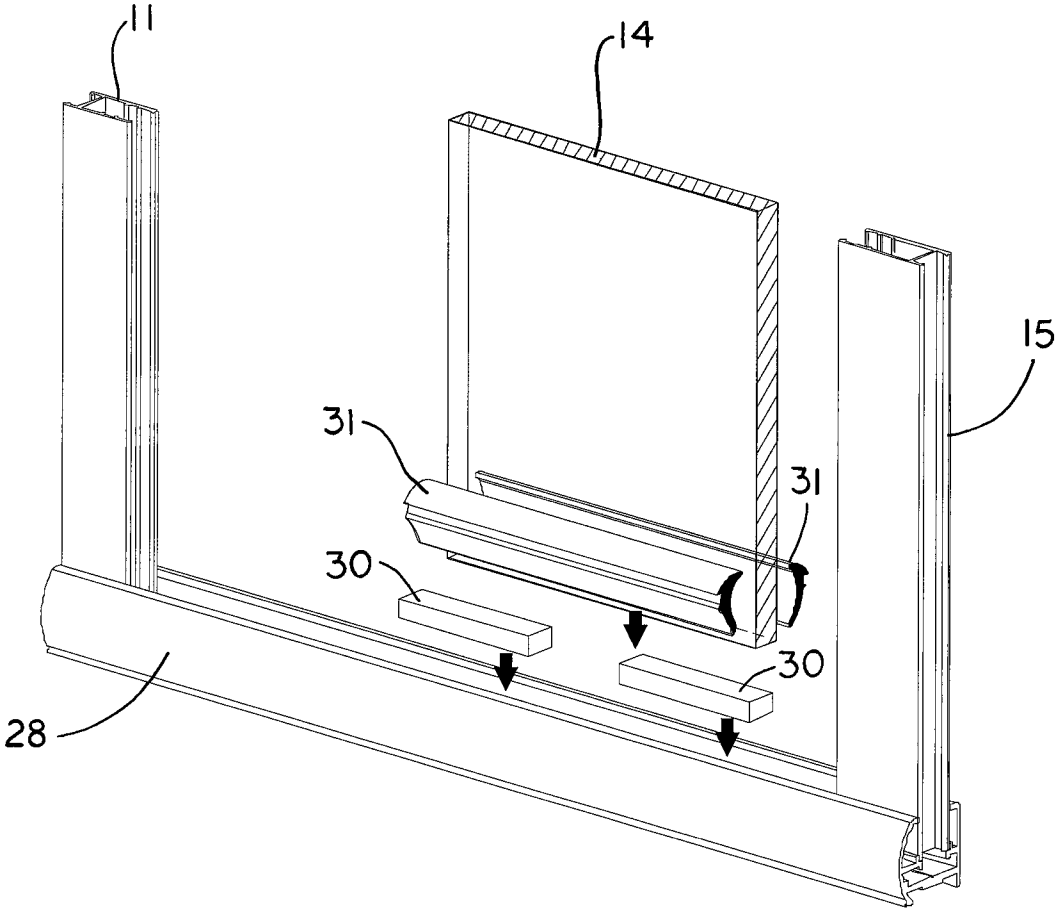
FIG. 5 shows the panel placement in relation to the setting assembly, sill assembly, and the wall jambs.

The next step is to insert two setting blocks 30 into the base member 28 cavity as shown in FIG. 5. A bead of caulking is then dispensed along the full length of the jambs 11, 15 on both inside walls of the shower enclosure 1. The panel 13, which is typically a glass panel, is set on top of the setting blocks 30 and slid into the panel wall jamb 15. The seals 31 are then sized and inserted to secure the panel 14 in place.

Figure 6:
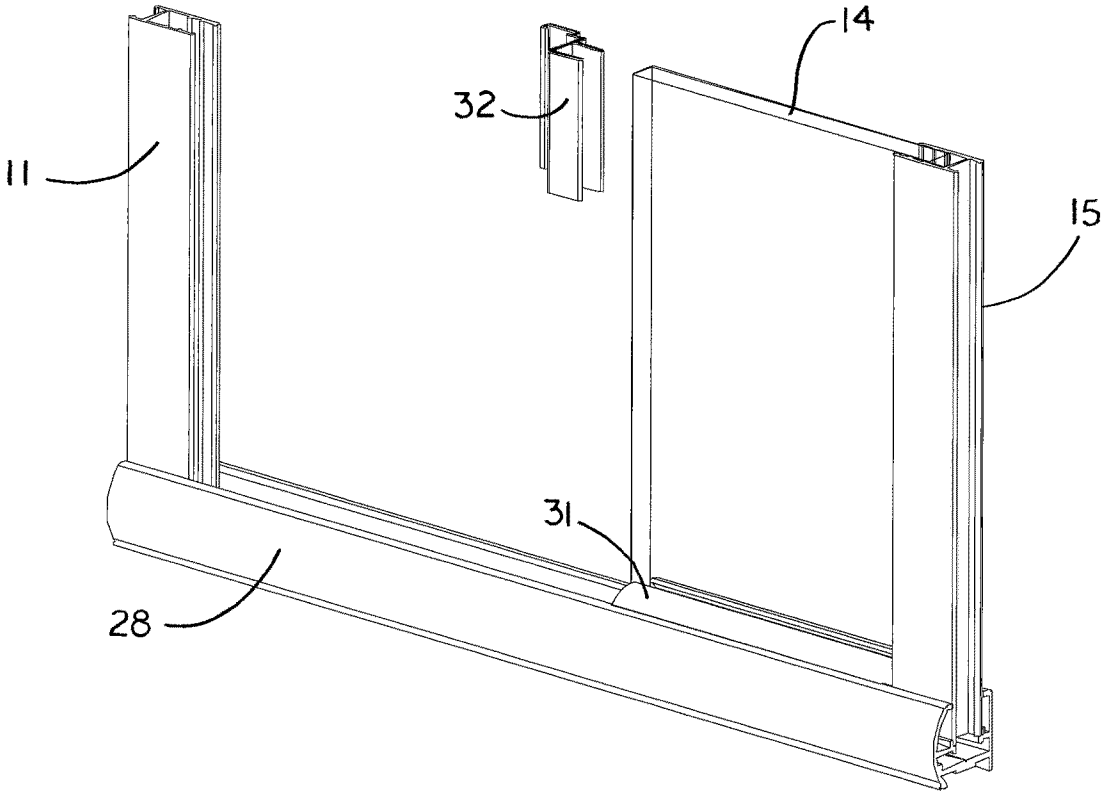
FIG. 6 shows the placement of the strike post in relation to the installed panel.
Figure 7:
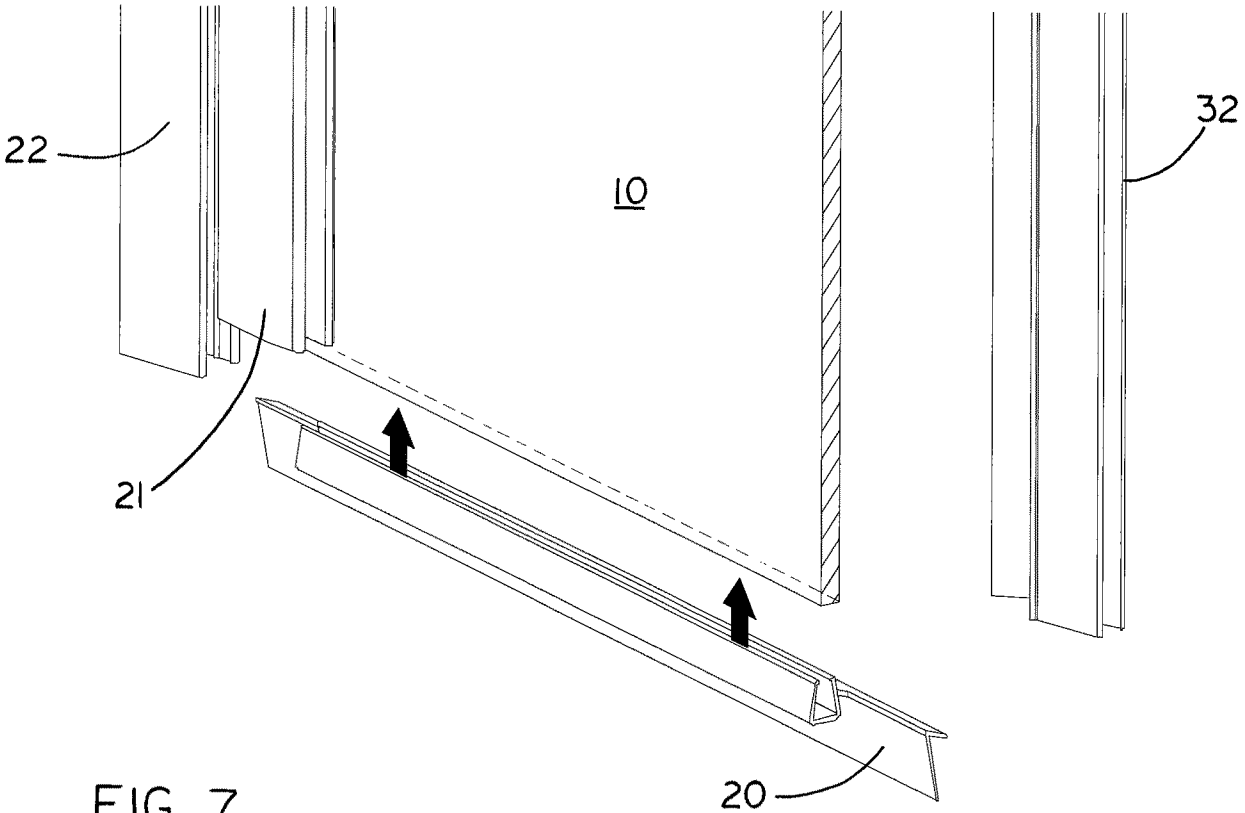
FIG. 7 shows the placement of the drip rail member in relation to the door.

Referring to FIG. 6, the width of the remaining door opening is measured from the edge of the door wall jamb 11 to the edge of the panel 14. The dam sill 29 (shown in FIG. 2) is sized to the measurement obtained, and it is then snapped into the base member 30 with the upright lip toward the outside of the shower enclosure 1. The strike post 32 is then installed and firmly seated onto the exposed edge of the panel 14. Referring to FIG. 7, the door 10, which is typically a glass panel, is then connected to the hinge stile 21, the hinge stile 21 is operably connected to the hinge post 22, and the hinge post 22 is connected to the door wall jamb 11 by inserting the hinge post 22 into the door wall jamb 11.

Referring again to FIG. 2, the strike plate 19 is centered and installed on the edge of glass of the door 10 that strikes the strike post 32. A measurement is then taken from the bottom of strike post 32 (where it sits on base member 28) to the bottom of the strike plate 19. The strike seal 33 is sized to be slightly longer than the measurement taken. The strike seal 33 is inserted into the strike post 32. The magnetic closure member 34 is then attached to the strike post 32. The strike seal 33 above the magnetic closure member 34 is then measured, sized, and attached to the strike post 32 in a similar manner The next step is to adjust the door 10 assembly along the sill curb) as needed to accommodate any custom features of the closure 1, or any misalignment or other fabrication errors of the frame 5. During these adjustments, the bottom of the door 10 should remain parallel to sill assembly 13 in order for the door 10 to operate properly. The hinge post 22 is secured to the door wall jamb 11 and aligned using adjustment screws 27 as needed or desired.

The jamb caps 35 can then be installed at both jambs 11, 15. The handle members 17 are then attached to the door 10 via the handle connectors 18 as shown in FIG. 2.

The drip rail member 20 is attached to the bottom edge of the door 10 as shown in FIG. 7. The drip rail member 20 should be sized to span along the entire length of the bottom of the door 10 without interfering with the strike post 32 and strike seal 33. In one embodiment, a bead of clear mildew resistant silicone is placed along the full length a cavity in the drip rail member 20, which enables a secure installation of the drip rail member 20 when it is positioned on the glass of the door 10.

Figure 8:
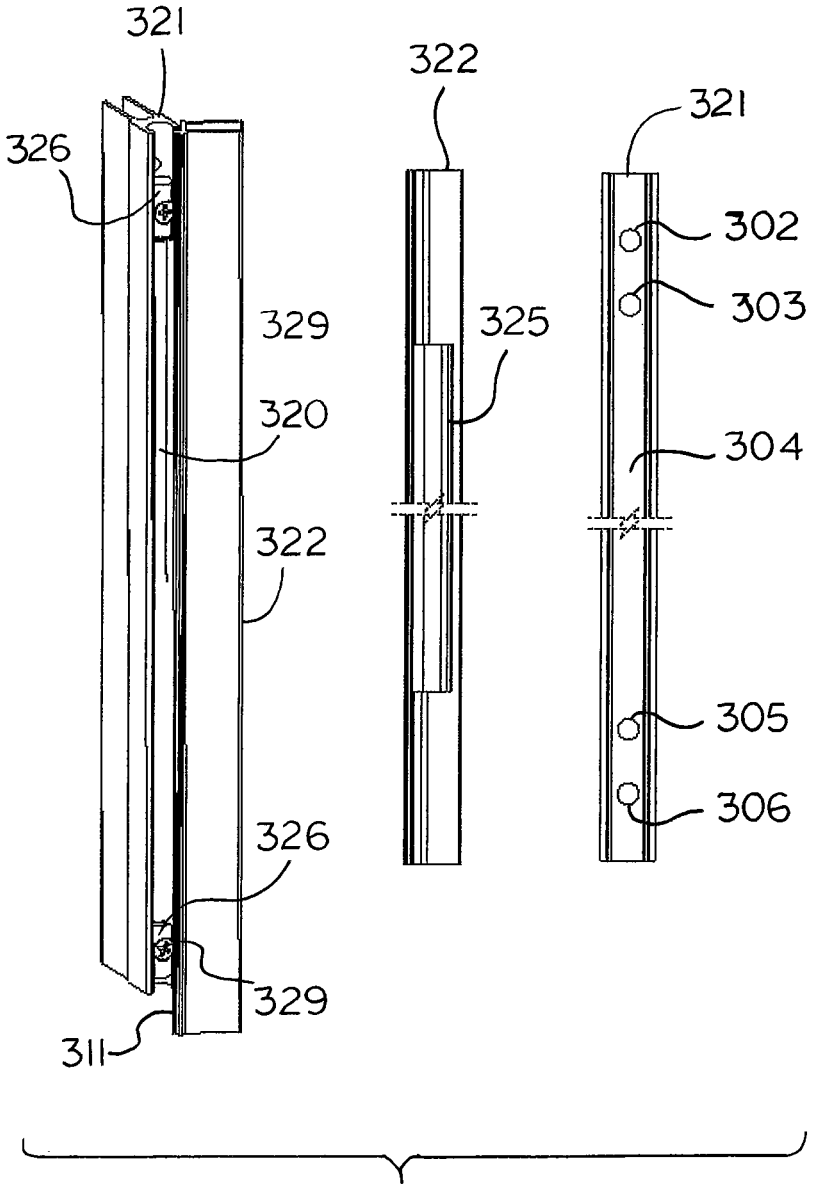
FIG. 8 shows the adjustable hinge stile and hinge post.
Figure 9:
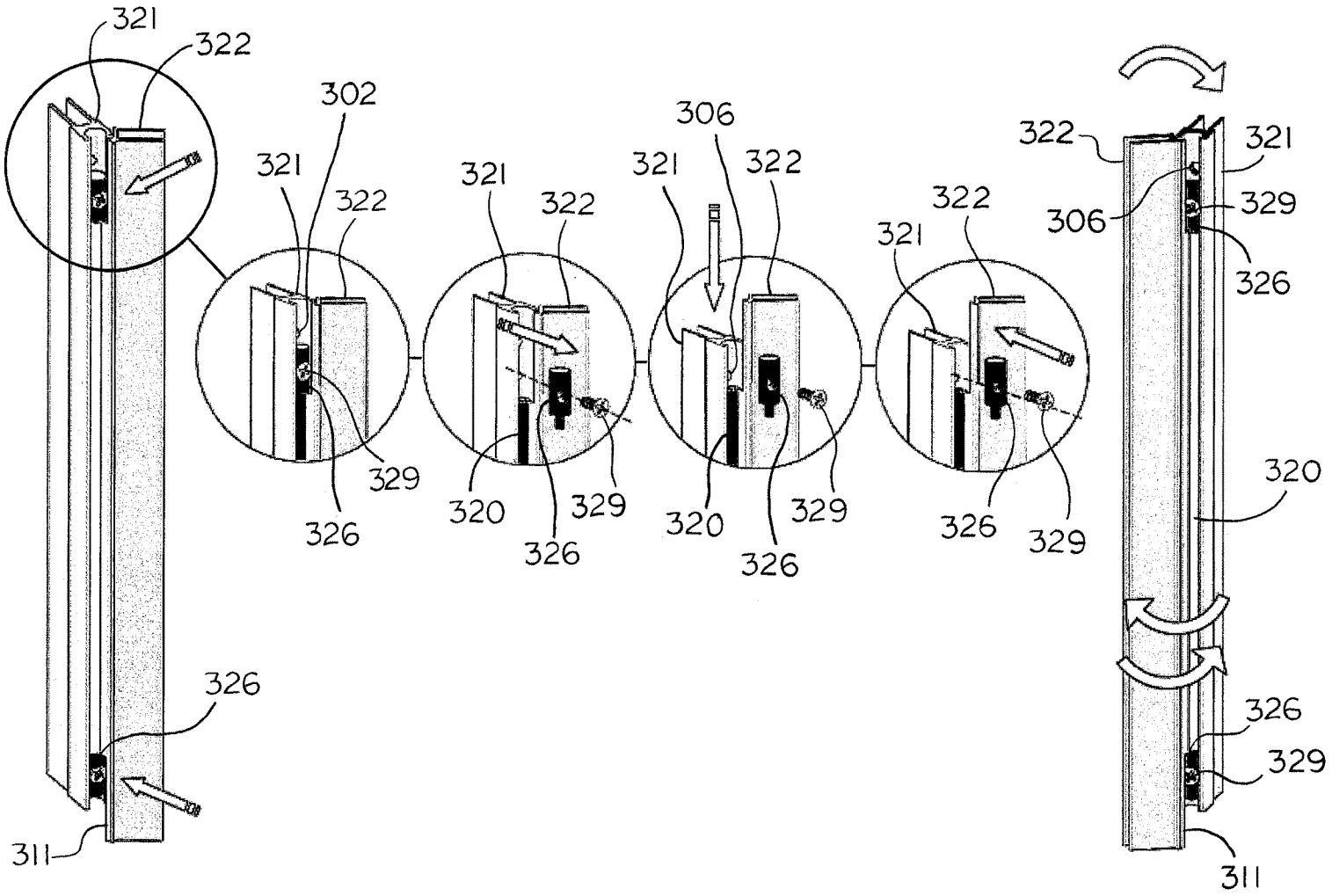
FIG. 9 shows the conversion of the hinge stile and hinge post from the first mating configuration to the second mating configuration.
Figure 10:
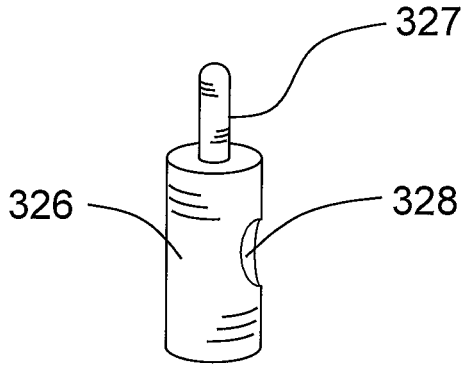
FIG. 10 shows an isometric view of one embodiment of a hinge pin.

In one embodiment of the hinge assembly, shown in FIGS. 8 and 9, the hinge stile 321 and the hinge post 322 are connected together by two hinge pins. The hinge stile 321 is an elongate member having a first side and a second side, the first side adapted for receiving a door 10 and the second side having a receiving slot 304 extending from a first end of the hinge stile 321 to a second end of the hinge stile 321. The second side of the hinge stile 321 has a first fastener hole 302, a second fastener hole 303, a third fastener hole 305, and a fourth fastener hole 306. These fasteners holes are disposed within an open faced, partially circular or C-shaped receiving slot 304 connected to the hinge stile 321. The hinge post 322 has a hollow hinge rod 325 connected to the hinge post 322 by a stem. In some embodiments, the hinge rod 325 takes a form having a C-shaped cross section. Referring to FIG. 10, the hinge pin comprises a cylindrical body 326 connected to an insert 327, which is a peg-like member. The body 326 has a receiving hole 328 for receiving a mechanical fastener 329 (shown in FIG. 8). The receiving slot 304 is sized to snugly receive the body 326 of the hinge pin.

Referring to FIG. 9, in one method of assembling the hinge, a hinge pin is inserted into the receiving slot 304 from the top with the insert 327 pointed downward, and another hinge pin is inserted into the receiving slot 304 from the bottom with the insert 327 pointed upward. The receiving hole 328 of the top hinge pin is aligned with the first fastener hole 302, and a fastener 329 is inserted through both holes to retain the hinge pin in place within the receiving slot 304. The receiving hole 328 in the bottom hinge pin is aligned with the fourth fastener hole 306, and a fastener 329 is inserted through both holes to retain the bottom hinge pin in place within the receiving slot 304.

The hinge rod 325 on the hinge post 322 runs partially along the length of the hinge post 322. The length of the hinge rod 325 is sized such that it can be placed between the opposing points of the inserts 327 of the secured hinge pins described above. The hinge post 322 is placed such that the hinge rod 325 is inserted into the receiving slot 304, and the hinge post 322 is raised until the insert 327 of the top hinge pin is inserted into the hollow portion of the hinge rod 325, where the insert 327 is sized to snugly fit inside the hinge rod 325. The fastener 329 of the lower hinge pin is released, and the receiving hole 328 is realigned with the third fastener hole 305, and the fastener 329 is reinserted through both holes to retain the bottom hinge pin in place. In this position, the insert 327 is inserted into the hinge rod 325, and the hinge rod 325 is seated against the body 326 of the lower hinge pin. The hinge stile 322 is then free to rotate with respect to the hinge post 322, and the assembly can then be attached to a door wall jamb.

As an alternative assembly method, the hinge post 322 is connected to the door wall jamb prior to attachment of the hinge stile 321. The connection method is similar to that described above, except that the hinge stile 321 is moved in relation to the fixed hinge post 322 to maneuver the hinge rod 325 in place with respect to the inserts 327 of the respective top and bottom hinge pins.

In some applications, it may be desirable to have one side of the door 10 facing in a certain direction. For example, it may be desirable to have one side of the door 10, such as a decorative side, facing away from the wet shower area, where the reverse water proof side remains facing the shower area. In other instances, some components of the closure system may arrive at the job site in a partially pre-assembled configuration, and disassembly is undesired to increase installation speed and save project cost. In these types of applications, it may desirable for the door 10 to maintain clearance over a base member or the sill assembly 13. Therefore, in another embodiment of the door assembly, the bottom of the hinge post 322 comprises an extension 311 with respect to the hinge stile 321. In this embodiment, the extension 311 enables the installed hinge stile 321 to maintain clearance over the sill assembly 13, base member, or other such bottom horizontal members as necessary or desired. The tops of the hinge stile 321 and the hinge post 322 should remain substantially flush with each other in these configurations. The placement of the fastener holes 302, 303, 305, and 306 allow for versatility of installation by enabling placement of the hinge stile 321 and the hinge post 322 in adjustable relation to each other. This enables the hinge post 322 to be placed on either the right side or the left side of a shower enclosure frame without requiring additional installation steps, such as cutting away excess lengths of the hinge post 322.

This is an advantage over prior systems, which required prefabrication of hinge posts to have an extension at both ends, the top end and the bottom end of the hinge post. When these prior systems were installed, the user determined whether to place the prefabricated hinge post on the right side or the left side of the shower enclosure frame to determine the correct orientation of the hinge post. The top extension of the prefabricated hinge post was then cut off of the hinge post at the job site so that the top of the hinge post was flush with the top of the hinge stile. The adjustability of the present system avoids the necessity of prefabricating hinge posts with extensions at both ends, thereby saving the cost of material and the time of additional installation steps at the job site.

For example, in an embodiment where the door 10 is configured to swing away from a shower enclosure area, the hinge post 322 of the present embodiment is configured for placement on either the right side or the left side of the shower entrance. The hinge stile 321 and hinge post 322 are configured for a first mating configuration and a second mating configuration. In the first mating configuration, shown in FIG. 9, the hinge post 322 is configured for placement on the left side of the shower doorway frame when viewed from outside the shower area. The extension 311 extends below the bottom of the hinge stile 321. The top hinge pin is aligned with the second fastener hole 303, and the bottom hinge pin is aligned with the fourth fastener hole 306. In this configuration, the bottom of the hinge post 322 extends below the bottom of the hinge stile 321, thus forming the extension 311 at the bottom of the hinge post 322, while the tops of the hinge stile 321 and hinge post 322 remain substantially flush with each other.

In an alternate way of describing the first mating configuration, the elongate hinge stile 321 has a first side and a second side, the first side adapted for receiving a door 10 and the second side having a C-shaped receiving slot 304 extending from a first end of the hinge stile 321 to a second end of the hinge stile 321, the hinge stile 321 further comprising a first fastener hole 302 and a second fastener hole 303 proximate to the first end of the hinge stile 321, and a third fastener hole 305 and a fourth fastener hole 306 proximate to the second end of the hinge stile 321. The hinge post 322 has a first end, a second end, a first side, and a second side, the first side having a hollow hinge rod 325 sized to fit snugly inside the C-shaped receiving slot 304 of the hinge stile 321, and the second side having a pair of extension flanges 312 for mating with a door wall jamb 11. The C-shaped receiving slot 304 of the hinge stile 321 is sized to snugly receive the hinge rod 325, the body 326 of the top hinge pin, and the body 326 of the bottom hinge pin, and the hollow portion of the hinge rod 325 is sized to snugly receive the insert 327 of the top hinge pin and the bottom hinge pin, the C-shaped receiving slot 304, hinge post 322, top hinge pin, and bottom hinge pin being configured to retain the hinge stile 321 and hinge post 322 in mating relation.

The first mating configuration further comprises the hinge rod 322 inserted into the C-shaped receiving slot 304 of the hinge stile 321, the top hinge pin aligned with the second fastener hole 303, and the bottom hinge pin aligned with the fourth fastener hole 306 such that the first end of the hinge post 322 is substantially flush with the first end of the hinge stile 321, and the second end of the hinge post 322 extends beyond the second end of the hinge stile 321 such that the second end of the hinge post 322 forms an extension 311 beyond the second end of the hinge stile 321. The hinge rod 325 has a top end and a bottom end, wherein in the first mating configuration, the insert 327 of the top hinge pin is configured for insertion into the top end of the hinge rod 325, and the insert 327 of the bottom hinge pin is configured for insertion into the bottom end of the hinge rod 325. The top hinge pin is adapted to be secured to the hinge stile 321 by a mechanical fastener 329 inserted through the receiving hole 328 of the top hinge pin and into the first fastener hole 302 or the second fastener hole 303 in the hinge stile 321. The bottom hinge pin is adapted to be secured to the hinge stile 321 by a mechanical fastener 329 inserted through the receiving hole 328 of the bottom hinge pin and into the third fastener hole 305 or the fourth fastener hole 306 in the hinge stile 321.

For installation on the right side of the shower doorway frame, or in the second mating configuration, the hinge stile 321 and the hinge post 322 are inverted and placed upside down on the right side of the shower doorway frame. The hinge stile 321 is also oriented upside down such that the fourth fastener hole 306 is the highest fastener hole, and the first fastener hole 302 is the lowest fastener hole. The top hinge pin is aligned with the third fastener hole 305, and the bottom hinge pin is aligned with the first fastener hole 302. In this configuration, the bottom of the hinge post 322 extends below the bottom of the hinge stile 321, thus forming the extension 311 at the bottom of the hinge post 322, while the tops of the hinge stile 321 and hinge post 322 remain substantially flush with each other. The fastener holes 302, 303, 305, and 306 therefore enable standard hinge stile 321 and hinge post 322 member to be interchangeably placed on either the left side or right side of the shower closure doorway while maintaining a bottom extension 311 of the hinge post 322 and a flush top alignment of the members. This interchangeability is enabled without the need to cut away any excess portions of the hinge post 322.

Stated another way, the second mating configuration comprises the hinge rod 325 inserted into the C-shaped receiving slot 304 of the hinge stile 321, the top hinge pin aligned with the third fastener hole 305, and the bottom hinge pin aligned with the first fastener hole 302 such that the second end of the hinge post 322 is substantially flush with the second end of the hinge stile 321, and the first end of the hinge post 322 extends beyond the first end of the hinge stile 321 such that the first end of the hinge post 322 forms an extension 311 beyond the first end of the hinge stile 321. In the second mating configuration, the insert 327 of the top hinge pin is configured for insertion into the bottom end of the hinge rod 325, and the insert 327 of the bottom hinge pin is configured for insertion into the top end of the hinge rod 325. The top hinge pin is adapted to be secured to the hinge stile 321 by a mechanical fastener 329 inserted through the receiving hole 328 of the top hinge pin and into the third fastener hole 305 or the fourth fastener hole 306 in the hinge stile 321. The bottom hinge pin is adapted to be secured to the hinge stile 321 by a mechanical fastener 329 inserted through the receiving hole 328 of the bottom hinge pin and into the first fastener hole 302 or the second fastener hole 303 in the hinge stile 321.

Again referring to FIG. 9, to move the hinge post 322 from the left side of the door to the right side of the door, the fastener 329 is removed from the second fastener hole 303 and the top hinge pin, which was in. The fastener 329 is also removed from the bottom hinge pin and the fourth fastener hole 306. The hinge stile 321 and hinge post 322 member are turned upside down, so that the fourth fastener hole 306 is at the top of the hinge stile 321 and the first fastener hole 302 is at the bottom of the hinge stile 321. The top hinge pin is placed in the receiving slot 304 so that the insert 327 enters the hinge rod 325, and the receiving hole 328 of the top hinge pin is aligned with the third fastener hole 105, which is now the second hole from the top of the hinge stile 321. The fastener 329 is placed through the receiving hole 328 and into the third fastener hole 305 to retain the hinge pin in place. The bottom hinge pin is aligned with and connected to the first fastener hole 302 by the fastener 329, as described above. The door assembly is now ready for attachment to the right side of the doorway frame with the extension 311 of the hinge post 322 extending below the hinge stile 321.

Figure 11:
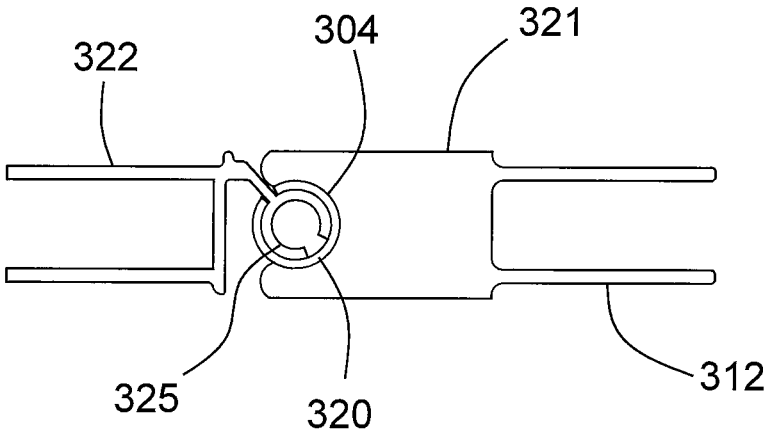
FIG. 11 is a cross section of the hinge post and the hinge stile, showing placement of the sleeve between the receiving slot and the receiving member.

In another embodiment, shown in FIG. 11, the hinge assembly further comprises a sleeve 320 having a C-shaped cross section. The outer side of the sleeve 320 is sized to snugly fit inside the receiving slot 304 of the hinge stile 321, and the inner side of the sleeve 320 is sized to snugly receive the hinge rod 325. The sleeve 320 is made of a resilient material, such as a hard rubber or a plastic. The sleeve 320 permits rotatability in the hinge assembly by reducing friction between the hinge rod 325 and the receiving slot 304. The sleeve 320 is preferably disposed along the full length of the hinge rod 325, although partial or intermittent placement along the hinge rod 325 also enables adequate performance of the hinge assembly.

The foregoing embodiments are merely representative of the door assembly disclosed herein, and not meant for limitation of the invention. For example, persons skilled in the art would appreciate that there are several embodiments and configurations of hinge posts, hinge stiles, and other components will not substantially alter the nature of the shower door assembly. Likewise, elements and features of the disclosed embodiments could be substituted or interchanged with elements and features of other embodiments, as will be appreciated by an ordinary practitioner. Consequently, it is understood that equivalents and substitutions for certain elements and components set forth above are part of the invention described herein, and the true scope of the invention is set forth in the claims below.

I claim:

1. An adjustable shower door assembly comprising:

an elongate hinge stile having a first side and a second side, the first side adapted for receiving a door panel and the second side having a C-shaped receiving slot extending from a first end of the hinge stile to a second end of the hinge stile, the hinge stile further comprising a first fastener hole and a second fastener hole proximate to the first end of the hinge stile, and a third fastener hole and a fourth fastener hole proximate to the second end of the hinge stile;

a top hinge pin and a bottom hinge pin, each of the top and bottom hinge pins having a body connected to an insert, each body having a receiving hole for receiving a mechanical fastener; and a hinge post having a first end, a second end, a first side, and a second side, the first side having a hollow hinge rod sized to form-fit inside the C-shaped receiving slot of the hinge stile, and the second side having a pair of extension flanges for mating with a door wall jamb;

wherein the C-shaped receiving slot of the hinge stile is sized to receive the hinge rod, the body of the top hinge pin, and the body of the bottom hinge pin, and the hollow portion of the hinge rod is sized to receive the insert of the top hinge pin and the bottom hinge pin, the C-shaped receiving slot, hinge post, top hinge pin, and bottom hinge pin being configured to retain the hinge stile and hinge post in mating relation.

2. The adjustable shower door assembly of claim 1, wherein the hinge stile and the hinge post are configured for a first mating configuration and a second mating configuration;

the first mating configuration comprising the hinge rod inserted into the C-shaped receiving slot of the hinge stile, the top hinge pin aligned with the second fastener hole, and the bottom hinge pin aligned with the fourth fastener hole such that the first end of the hinge post is substantially flush with the first end of the hinge stile, and the second end of the hinge post extends beyond the second end of the hinge stile such that the second end of the hinge post forms an extension beyond the second end of the hinge stile; and the second mating configuration comprising the hinge rod inserted into the C-shaped receiving slot of the hinge stile, the top hinge pin aligned with the third fastener hole, and the bottom hinge pin aligned with the first fastener hole such that the second end of the hinge post is substantially flush with the second end of the hinge stile, and the first end of the hinge post extends beyond the first end of the hinge stile such that the first end of the hinge post forms an extension beyond the first end of the hinge stile.

3. The adjustable shower door assembly of claim 2, the hinge rod further comprising a top end and a bottom end, wherein:

in the first mating configuration, the insert of the top hinge pin is configured for insertion into the top end of the hinge rod, and the insert of the bottom hinge pin is configured for insertion into the bottom end of the hinge rod; and in the second mating configuration, the insert of the top hinge pin is configured for insertion into the bottom end of the hinge rod, and the insert of the bottom hinge pin is configured for insertion into the top end of the hinge rod.

4. The adjustable shower door assembly of claim 3, wherein:

in the first mating configuration:

(a) the top hinge pin is adapted to be secured to the hinge stile by a mechanical fastener inserted through the receiving hole of the top hinge pin and into the first fastener hole or the second fastener hole in the hinge stile; and (b) the bottom hinge pin is adapted to be secured to the hinge stile by a mechanical fastener inserted through the receiving hole of the bottom hinge pin and into the third fastener hole or the fourth fastener hole in the hinge stile; and in the second mating configuration:

(a) the top hinge pin is adapted to be secured to the hinge stile by a mechanical fastener inserted through the receiving hole of the top hinge pin and into the third fastener hole or the fourth fastener hole in the hinge stile; and (b) the bottom hinge pin is adapted to be secured to the hinge stile by a mechanical fastener inserted through the receiving hole of the bottom hinge pin and into the first fastener hole or the second fastener hole in the hinge stile.

5. The adjustable shower door assembly of claim 2, wherein;

in the first mating configuration:

(a) the top hinge pin is adapted to be secured to the hinge stile by a mechanical fastener inserted through the receiving hole of the top hinge pin and into the first fastener hole or the second fastener hole in the hinge stile; and (b) the bottom hinge pin is adapted to be secured to the hinge stile by a mechanical fastener inserted through the receiving hole of the bottom hinge pin and into the third fastener hole or the fourth fastener hole in the hinge stile;

and in the second mating configuration:

(a) the top hinge pin is adapted to be secured to the hinge stile by a mechanical fastener inserted through the receiving hole of the top hinge pin and into the third fastener hole or the fourth fastener hole in the hinge stile; and (b) the bottom hinge pin is adapted to be secured to the hinge stile by a mechanical fastener inserted through the receiving hole of the bottom hinge pin and into the first fastener hole or the second fastener hole in the hinge stile.

6. The adjustable shower door assembly of claim 1, the hinge rod further comprising a top end and a bottom end, wherein: the insert of the top hinge pin is configured for insertion into the top end of the hinge rod, and the insert of the bottom hinge pin is configured for insertion into the bottom end of the hinge rod.

7. The adjustable shower door assembly of claim 6, wherein:

the top hinge pin is adapted to be secured to the hinge stile by a mechanical fastener inserted through the receiving hole of the top hinge pin and into the first fastener hole or the second fastener hole in the hinge stile; and the bottom hinge pin is adapted to be secured to the hinge stile by a mechanical fastener inserted through the receiving hole of the bottom hinge pin and into the third fastener hole or the fourth fastener hole in the hinge stile.

8. The adjustable shower door assembly of claim 1, wherein:

the top hinge pin is adapted to be secured to the hinge stile by a mechanical fastener inserted through the receiving hole of the top hinge pin and into the first fastener hole or the second fastener hole in the hinge stile; and the bottom hinge pin is adapted to be secured to the hinge stile by a mechanical fastener inserted through the receiving hole of the bottom hinge pin and into the third fastener hole or the fourth fastener hole in the hinge stile.

9. An adjustable shower door assembly comprising:

a door and a panel, the door and the panel configured for adjacent placement on a sill assembly, the panel further supported by a setting assembly;

an elongate hinge stile having a first side and a second side, the first side adapted for receiving the door and the second side having a C-shaped receiving slot extending from a first end of the hinge stile to a second end of the hinge stile, the hinge stile further comprising a first fastener hole and a second fastener hole proximate to the first end of the hinge stile, and a third fastener hole and a fourth fastener hole proximate to the second end of the hinge stile;

a top hinge pin and a bottom hinge pin, each of the top and bottom hinge pins having a body connected to an insert, each body having a receiving hole for receiving a mechanical fastener; and a hinge post having a first end, a. second end, a first side, and a second side, the first side having a hollow hinge rod sized to form-fit inside the C-shaped receiving slot of the hinge stile, and the second side having a pair of extension flanges for mating with a door wall jamb;

wherein the C-shaped receiving slot of the hinge stile is sized to receive the hinge rod, the body of the top hinge pin, and the body of the bottom hinge pin, and the hollow portion of the hinge rod is sized to receive the insert of the top hinge pin and the bottom hinge pin, the C-shaped receiving slot, hinge post, top hinge pin, and bottom hinge pin being configured to retain the hinge stile and hinge post in mating relation.

10. The adjustable shower door assembly of claim 9, wherein the hinge stile and the hinge post are configured for a first mating configuration and a second mating configuration;

the first mating configuration comprising the hinge rod inserted into the C-shaped receiving slot of the hinge stile, the top hinge pin aligned with the second fastener hole, and the bottom hinge pin aligned with the fourth fastener hole such that the first end of the hinge post is substantially flush with the first end of the hinge stile, and the second end of the hinge post extends beyond the second end of the hinge stile such that the second end of the hinge post forms an extension beyond the second end of the hinge stile; and the second mating configuration comprising the hinge rod inserted into the C-shaped receiving slot of the hinge stile, the top hinge pin aligned with the third fastener hole, and the bottom hinge pin aligned with the first fastener hole such that the second end of the hinge post is substantially flush with the second end of the hinge stile, and the first end of the hinge post extends beyond the first end of the hinge stile such that the first end of the hinge post forms an extension beyond the first end of the hinge stile.

11. The adjustable shower door assembly of claim 10, the hinge rod further comprising a top end and a bottom end, wherein:

in the first mating configuration, the insert of the top hinge pin is configured for insertion into the top end of the hinge rod, and the insert of the bottom hinge pin is configured for insertion into the bottom end of the hinge rod; and in the second mating configuration, the insert of the top hinge pin is configured for insertion into the bottom end of the hinge rod, and the insert of the bottom hinge pin is configured for insertion into the top end of the hinge rod.

12. The adjustable shower door assembly of claim 11, wherein:

in the first mating configuration:

(a) the top hinge pin is adapted to be secured to the hinge stile by a mechanical fastener inserted through the receiving hole of the top hinge pin and into the first fastener hole or the second fastener hole in the hinge stile; and (b) the bottom hinge pin is adapted to be secured to the hinge stile by a mechanical fastener inserted through the receiving hole of the bottom hinge pin and into the third fastener hole or the fourth fastener hole in the hinge stile; and in the second mating configuration:

(a) the top hinge pin is adapted to be secured to the hinge stile by a mechanical fastener inserted through the receiving hole of the top hinge pin and into the third fastener hole or the fourth fastener hole in the hinge stile; and (b) the bottom hinge pin is adapted to be secured to the hinge stile by a mechanical fastener inserted through the receiving hole of the bottom hinge pin and into the first fastener hole or the second fastener hole in the hinge stile.

13. The adjustable shower door assembly of claim 10, wherein:

in the first mating configuration:

(a) the top hinge pin is adapted to be secured to the hinge stile by a mechanical fastener inserted through the receiving hole of the top hinge pin and into the first fastener hole or the second fastener hole in the hinge stile; and (b) the bottom hinge pin is adapted to be secured to the hinge stile by a mechanical fastener inserted through the receiving hole of the bottom hinge pin and into the third fastener hole or the fourth fastener hole in the hinge stile;

and in the second mating configuration:

(a) the top hinge pin is adapted to be secured to the hinge stile by a mechanical fastener inserted through the receiving hole of the top hinge pin and into the third fastener hole or the fourth fastener hole in the hinge stile; and (b) the bottom hinge pin is adapted to be secured to the hinge stile by a mechanical fastener inserted through the receiving hole of the bottom hinge pin and into the first fastener hole or the second fastener hole in the hinge stile.

14. The adjustable shower door assembly of claim 9, the hinge rod further comprising a top end and a bottom end, wherein: the insert of the top hinge pin is configured for insertion into the top end of the hinge rod, and the insert of the bottom hinge pin is configured for insertion into the bottom end of the hinge rod.

15. The adjustable shower door assembly of claim 14, wherein:

the top hinge pin is adapted to be secured to the hinge stile by a mechanical fastener inserted through the receiving hole of the top hinge pin and into the first fastener hole or the second fastener hole in the hinge stile; and the bottom hinge pin is adapted to be secured to the hinge stile by a mechanical fastener inserted through the receiving hole of the bottom hinge pin and into the third fastener hole or the fourth fastener hole in the hinge stile.

16. The adjustable shower door assembly of claim 9, wherein:

the top hinge pin is adapted to be secured to the hinge stile by a mechanical fastener inserted through the receiving hole of the top hinge pin and into the first fastener hole or the second fastener hole in the hinge stile; and the bottom hinge pin is adapted to be secured to the hinge stile by a mechanical fastener inserted through the receiving hole of the bottom hinge pin and into the third fastener hole or the fourth fastener hole in the hinge stile.

* * * * *